United States Patent [19]

Matsui

[11] Patent Number: 4,568,858

[45] Date of Patent: Feb. 4, 1986

[54] LAMP CONTROL CIRCUIT

[75] Inventor: Kōichi Matsui, Tokyo, Japan

[73] Assignee: Olympus Optical Co., Ltd., Tokyo, Japan

[21] Appl. No.: 543,612

[22] Filed: Oct. 20, 1983

[30] Foreign Application Priority Data

Oct. 27, 1982 [JP] Japan ..... 57-188644

[51] Int. Cl.[4] ..... H05B 37/04; H05B 39/08

[52] U.S. Cl. ..... 315/198; 315/199; 315/154; 315/157; 315/159

[58] Field of Search ..... 315/198, 199, 154, 157, 315/159, 292, 316

[56] References Cited

U.S. PATENT DOCUMENTS

| | | | |
|---|---|---|---|
| 3,564,332 | 2/1971 | Blakeslee | 315/154 |
| 3,898,516 | 8/1975 | Nakasone | 315/199 X |
| 3,968,401 | 7/1976 | Bryant | 315/293 |
| 4,008,416 | 2/1977 | Nakasone | 315/199 X |
| 4,057,751 | 11/1977 | Bonsignore et al. | 315/198 X |
| 4,241,295 | 12/1980 | Williams, Jr. | 315/199 X |
| 4,359,670 | 11/1982 | Hosaka et al. | 315/199 X |
| 4,396,869 | 8/1983 | Rosenbaum et al. | 315/199 X |

FOREIGN PATENT DOCUMENTS

| | | | |
|---|---|---|---|
| 2318444 | 4/1973 | Fed. Rep. of Germany . | |
| 2451146 | 11/1980 | France | 315/199 |

OTHER PUBLICATIONS

Elektronik, vol. 3, Feb. 7, 1980; Francis-Verlag; Munich. J. Grosse, W. Stegner "Lichtdimmen und Schalten Elektrischer Gerate mit Infrarot-Fernsteuerung", pp. 69-83.

*Primary Examiner*—David K. Moore
*Assistant Examiner*—Vincent DeLuca
*Attorney, Agent, or Firm*—Frishauf, Holtz, Goodman & Woodward

[57] ABSTRACT

A lamp control control circuit has triacs for controlling a current from an AC power supply and supplying a controlled current to lamps; a phase angle control unit for generating phase angle control pulses for a soft start; switching controllers for triggering the triacs in response to phase angle control pulses, respectively; and switches for selecting the lamp which is to be energized. The control circuit has additional switches for detecting the lamp selecting operation of the switches. The phase angle control unit is started in response to a signal from those switches.

12 Claims, 2 Drawing Figures

LAMP CONTROL CIRCUIT

BACKGROUND OF THE INVENTION

The present invention relates to a lamp control circuit for selectively controlling the power supply to a plurality of lamps used as the light source of an endoscope system.

Endoscope system lighting is indispensable to endoscopic diagnosis. If a light source of the endoscope system comprises a single lamp, the endoscopic diagnosis must be interrupted upon lamp breakdown. To avoid this, two lamps, for example, may be arranged within the light supply unit of an endoscope system. A switch is arranged to switch the lamps. The switch is operated to select one of the lamps at the beginning of endoscopic diagnosis. Alternatively, the switch may be operated to select the second lamp when the first lamp is burnt out.

Halogen lamps are suitable for use as the light source of an endoscope system, since they emit light rays of high intensity. However, halogen lamps tend to be burnt out upon an abrupt increase in power. For example, when power is abruptly supplied to the halogen lamp, upon the turning on of the power switch, the filament of the halogen lamp tends to be disconnected, even if the power supplied is rated power.

In the conventional light supply unit of the endoscope system, a soft starter circuit, operated upon initiation of power supply, is used to prevent the disconnection (or burning out) of a halogen lamp. For this reason, when the first lamp is switched to the second lamp, without turning off the power supply, the second lamp can be turned on with only low precision, thus degrading the reliability of the light supply unit.

SUMMARY OF THE INVENTION

The main object of the present invention is to provide a lamp control circuit wherein lamp breakdown, which is caused by lamp switching for the backup operation after power is supplied, is prevented.

To achieve the above object, a lamp control circuit is provided, which comprises: switching elements respectively connected to the power lines of a plurality of lamps; a lamp selector for selecting at least one of the lamps, and for generating a signal indicating that at least one of the lamps is selected; and a soft start controller for supplying control pulses to a selected switching element in response to the signal from the lamp selector, wherein ON time periods of the selected switching element is gradually increased.

DETAILED DESCRIPTION OF THE PREFERRED EMBODIMENT

Figure 1:
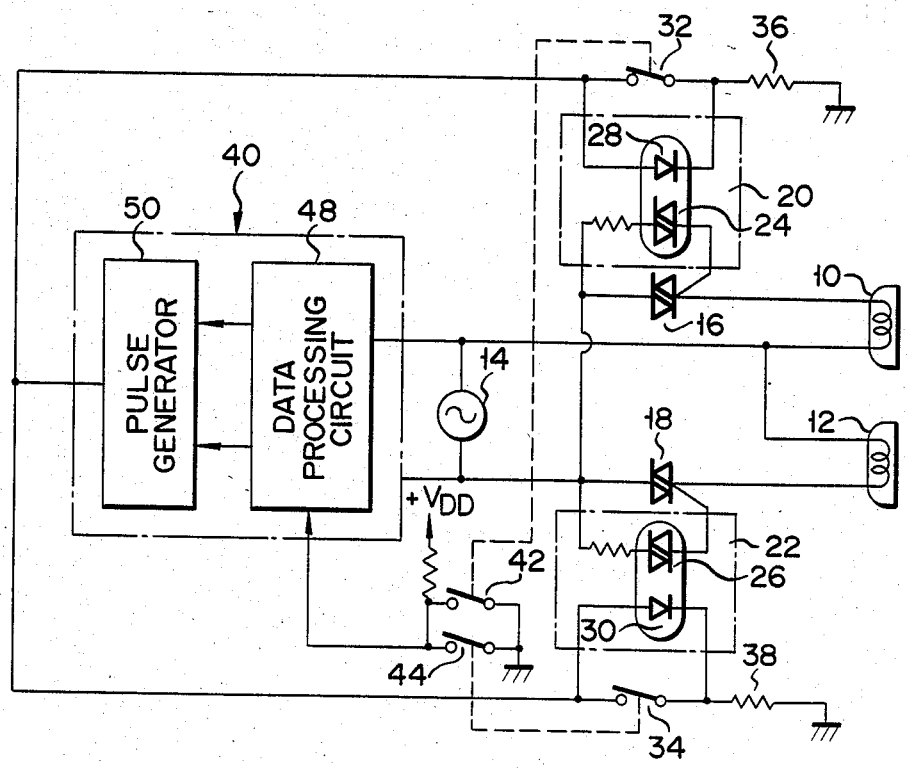
FIG. 1 shows a lamp control circuit according to an embodiment of the present invention.

FIG. 1 shows a lamp control circuit according to an embodiment of the present invention. Halogen lamps 10 and 12 are arranged as a normal light source and a backup light source, respectively, within the light supply unit of an endoscope system (not shown). The lamps 10 and 12 are connected to an AC power supply 14 through switching elements (e.g., through triacs 16 and 18), respectively. The triacs 16 and 18 are rendered conductive under the control of switching controllers 20 and 22, respectively. The switching controllers 20 and 22 have phototriacs 24 and 26 connected to the control gates of the triacs 16 and 18 through resistors, and light-emitting diodes 28 and 30 photocoupled to the phototriacs 24 and 26, respectively. The triacs 16 and 18 receive gate currents for triggering through the phototriacs 24 and 26 which are rendered conductive upon light emission of the light-emitting diodes 28 and 30 of the switching controllers 20 and 22, respectively. Light-emitting diodes 28 and 30 are connected in parallel to switches 32 and 34, which are used in switching the energization of lamps 12 and 10, respectively. The cathodes of light-emitting diodes 28 and 30 are grounded, through resistors 36 and 38, respectively. The anodes of the light-emitting diodes 28, 30 are commonly connected to an output terminal of a phase angle control unit 40. Switches 42 and 44 are interlocked with the switches 32 and 34, respectively. One terminal of a parallel circuit of the switches 42 and 44 is connected to the DC power supply +VDD through a resistor, and the other terminal thereof is grounded. This parallel circuit generates a control signal upon operation of at least one of switches 32 and 34. The phase angle control unit 40 comprises: a data processing circuit 48 for sequentially generating predetermined data representing the amounts of light from the lamps 10, 12, from smaller data to larger data, in response to the control signal "L" from the parallel circuit; and a pulse generator 50 for generating phase angle control pulses corresponding to data from the data processing circuit 48. The data processing circuit 48 comprises, for example, a CPU, a memory, a counter, and a zero-crossing detector. Assume that the amount of light in the endoscopic diagnosis is given as 100%. Ten items of light amount data respectively corresponding to 10%, 11%, 12%, 14%, 17%, 20%, 25%, 33%, 50% and 100%, for example, are stored in the memory. The data are read out beginning from the the memory from smaller data. The number of zero-crossings which corresponds to the output period (e.g., 0.1 sec) of one item of light amount data is preset in the counter. The counter is connected to the zero-crossing detector which detects the zero-crossing of an AC voltage from the AC power supply 14. The CPU receives the signals from the counter each of which represents that the number of zero-crossings has reached a preset value. The CPU also fetches the control signal through the switches 42 and 44. The CPU generates first light amount data in response to the low level control signal "L" through the switch 42 or 44, and then updates the output data in response to the signal from the counter. The pulse generator 50 comprises, for example, MPU "DPC-1" (SANWA ELECTRIC CO., LTD., JAPAN). The pulse generator 50 has: data and command input ports for receiving the light amount data and operation instructions from the CPU of the data processing circuit 48; a zero-crossing input terminal for receiving the output signal from the zero-crossing detector; and output terminal for supplying phase angle control pulses to the switching controller 20, 25; and so on. The phase angle control pulses rise at that phase angle of an AC voltage of the power supply 14 which corresponds to the light amount data, and fall at the immediately following zero-crossing point of the AC voltage.

The operation of the lamp control circuit may be described as follows. When power is supplied from the AC power supply 14, switches 32 and 34 are held open. Switches 42 and 44 are also held open, in synchronism with switches 32 and 34, respectively. The high level control signal "H" is supplied to the data processing circuit 48. While the CPU of the data processing circuit 48 receives the control signal "H", the CPU supplies a no-operation instruction to the pulse generator 50. Therefore, the pulse generator 50 does not generate pulses, so that its output level is kept low (i.e., at OV). A current does not flow through the light-emitting diodes 28, 30 of the switching controllers 20, 22. Switching controllers 20 and 22 do not supply gate currents to triacs 16 and 18, respectively. Thepower from the AC power supply 14 is interrupted by the triacs 16, 18, so that the lamp 10 is kept OFF.

To turn on the (normal) lamp 10, switch 34 is closed. The light-emitting diode 30 is short-circuited by switch 34 and disables the function of the switching controller 22 adapted to trigger the triac 18. Meanwhile, the switch 44 is closed upon the closing operation of the switch 34, so that the control signal "L" is supplied to the data processing circuit 48. The CPU releases the no-operation state of the pulse generator 50, in response to the control signal "L", and supplies the smallest light amount data from the memory to the pulse generator 50. The pulse generator 50 generates phase angle control pulses having a pulse width corresponding to the light amount data, according to the timing of the voltage zero-crossing point (as the falling reference) of the AC power supply 14. Such control pulses are supplied to the switching controllers 20, 22. In this case, since the light-emitting diode 30 of the switching controller 22 is short-circuited, the light-emitting diode 30 does not emit light. As a result, the triac 18 is not triggered by the switching controller 22 and prevents power supply to the lamp 12. Meanwhile, the light-emitting diode 28 of the switching controller 20 is turned on/off in response to the phase angle control pulses. The phototriac 24 of the switching controller 20 repeatedly triggers the triac 16 in response to light emission of the light-emitting diode 28. The triac 16 is rendered conductive during a period from a moment when the triac 16 is triggered by the switching controller 20 to a moment when the immediately following zero-crossing point of the AC power supply 14 appears. The lamp 10 is energized by power from the AC power supply 14 in response to the switching operation of the triac 16. In this case, the lamp actually flickers. However, when the AC power supply 14 is a commercial power supply having a frequency of 50 or 60 Hz, the lamp is substantially kept ON, though the ON period of the triac 16 is shorter than the period of the AC power supply. For this reason, the power supplied to the lamp 10 is mininal, and a light amount proportional to this power is less than that of the light amount data.

Figure 2:
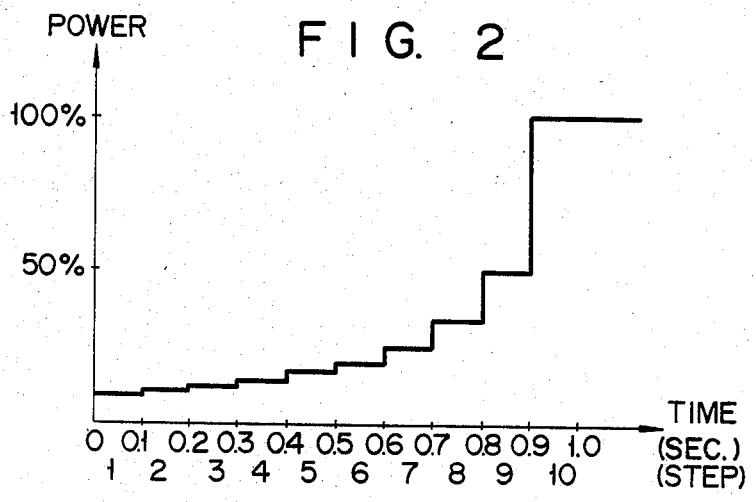
FIG. 2 is a graph for use in explaining the power supplied to a halogen lamp (to be turned on) as a function of time.

The counter of the data circuit 48 starts counting the outputs of the zero-crossing detector, in response to the control signal "L" received through the switch 44. Each time the counter counts a predetermined number of the outputs from the zero-crossing detector, the counter supplies a signal to the CPU. The CPU responds to the signals from the counter and reads out the smallest data among the remaining light amount data from the memory. The readout smallest data is supplied to the pulse generator 50. The final light amount data (i.e., "100%" data) is continuously supplied to the pulse generator 50. This operation of the CPU continues until the control signal "H" is re-supplied to the CPU through switches 44 and 42. The pulse generator 50 generates phase angle control pulses having a pulse width which is gradually increased, upon updating of the light amount data from the CPU of the data circuit 48. For example, when 10 items of light amount data are updated at intervals of 0.1 seconds, the power supplied to the lamp (i.e., the light amount of the lamp) is increased, as shown in FIG. 2.

Assuming that the lamp which is kept ON burns out during the endoscopic diagnosis, switch 34 will be opened. Switch 44 will also be opened, in synchronism with switch 34. The control signal "H" is then supplied to the data circuit 48. The CPU stops generating the light amount data, in response to this control signal "H", and supplies the no-operation instruction to the pulse generator 50. The lamp 10 is thus de-energized. When the switch 32 is closed, the switch 42 is closed in synchronism with the switch 32. As a result, the control signal "L" is supplied to the CPU of the data circuit 48. Thereafter, the backup lamp 12 is controlled in the soft start mode, as previously described.

In the lamp control circuit of this embodiment, the selecting operation of the lamps is detected. In response to this detection, the triacs arranged between the AC power supply 14 and lamps 10 and 12 are so controlled that the ON time periods of the triacs are sequentially increased. Therefore, a surge current does not abruptly flow through lamps 10 or 12.

According to the lamp control circuit of the present invention, the lamps may be selected for backup operation while power is being supplied. In such a case, the selected lamp receives the power which is phase-angle controlled to be gradually increased. Therefore, the burning out of the lamp can be reliably prevented.

In particular, the lamp control circuit of the present invention provides a highly reliable endoscope lighting system.

What is claimed is:

1. A lamp control circuit for an endoscope in which the first and second lamps are selectively lit, comprising:

first and second switching means respectively connected to power lines of said first and second lamps;

first and second switching control means responsive to input pulses for respectively actuating said first and second switching means during each period of said input pulses;

selecting means responsive to providing an enable signal to operate one of said lamps for inhibiting the operation of the one of said first and second switching control means associated with the other of said lamps, and responsive to non-operation of one of said lamps for inhibiting operation of the one of said first and second switching control means associated with the non-operating lamp, said selecting means including means for generating said enable signal to operate one of said lamps;

said selecting means including first and second switch means coupled respectively to said first and second switching control means, each of said first and second switch means including first and second switches, one of which is coupled to said switching control means and the other of which is coupled to selectively generate said enable signal; and a single soft start control means responsive to said enable signal for generating control pulses of which durations are gradually increased and for selectively supplying the control pulses to said first and second switching control means as said input pulses such that when one of said first and second lamps is turned off, the other is turned on, under control of said lamp control circuit.

2. The lamp control circuit according to claim 1, wherein said soft start control means comprises:

data processing means for sequentially generating a predetermined number of light amount data beginning from smaller light amount data, in response to said enable signal;

detection means for detecting zero-crossings of an AC voltage supplied to said power lines of said first and second lamps; and pulse generating means for generating said control pulses synchronously with the phase of the output signal of said detection means; and for increasing the time duration of each of said control pulses corresponding to said light amount data sequentially generated by said data processing means.

3. The lamp control circuit according to claim 2, wherein said selecting means includes:

first and second manual switches operable for respectively cancelling the control pulses supplied to said first and second switching means; and sensing means for generating said enable signal in response to an operational movement of one of said first and second manual switches to cancel said control pulses.

4. The lamp control circuit according to claim 2, wherein:

said first switching control means includes first photocoupler means coupled to said first switching means; and said second switching control means includes second photocoupler means coupled to said second switching means.

5. The lamp control circuit according to claim 4, wherein each of said first and second photocoupler means include a respective pair of a light-emitting diode and a phototriac.

6. Thelamp control circuit according to claim 5, wherein each of said first and second switching means comprises a triac.

7. The lamp control circuit according to claim 1, wherein each of said first and second switching means comprises a triac.

8. The lamp control means according to claim 1, wherein said first and second lamps are one of a halogen type.

9. The lamp control means according to claim 6, wherein said triac of each of said first and second switching means is coupled so as to be controlled by a respective photocoupler means of each of said first and second switching control means, said selecting means comprising switch means coupled to said respective photocoupler means for inhibiting operation of said respective photocoupler means when said switch means is operated.

10. The lamp control circuit according to claim 9, wherein said switch means of said selecting means includes first and second manually operable switches.

11. The lamp control circuit according to claim 9 wherein said switch means of said selecting means each include first and second ganged switches, one of which is coupled to said respective photocoupler means to selectively inhibit operation of said photocoupler means, and the other of which is coupled to selectively generate said enable signal.

12. The lamp control circuit according to claim 1, wherein said first and second switches are ganged together.

* * * * *

UNITED STATES PATENT AND TRADEMARK OFFICE

CERTIFICATE OF CORRECTION

PATENT NO. : 4,568,858

DATED : February 4, 1986

INVENTOR(S) : Koichi MATSUI

It is certified that error appears in the above-identified patent and that said Letters Patent is hereby corrected as shown below:

Col. 2, lines 39-40, replace "the data are read out beginning from the memory from smaller data" with --the data are read out from the memory beginning from the smaller data--.

Signed and Sealed this

*Eighth* Day of *July 1986*

[SEAL]

*Attest:*

DONALD J. QUIGG

*Attesting Officer*

*Commissioner of Patents and Trademarks*